US005595091A

United States Patent [19]

Garman et al.

[11] Patent Number: 5,595,091

[45] Date of Patent: Jan. 21, 1997

[54] RESTRAINT MECHANISM FOR A CONTROL LEVER

[75] Inventors: Ronald H. Garman, Pekin; Stephen C. Garnett, Princeville; Steven L. Groth, Morton, all of Ill.

[73] Assignee: Caterpillar Inc., Peoria, Ill.

[21] Appl. No.: 430,973

[22] Filed: Apr. 28, 1995

[51] Int. Cl.[6] ..... G05G 1/00

[52] U.S. Cl. ..... 74/523; 74/526; 74/528

[58] Field of Search ..... 74/18, 18.1, 18.2, 74/473 R, 475, 526, 527, 471 R, 523, 528

[56] References Cited

U.S. PATENT DOCUMENTS

| | | | |
|---|---|---|---|
| 3,372,280 | 3/1968 | Auld et al. | 250/106 |
| 3,795,152 | 3/1974 | Campbell | 74/471 |
| 3,810,369 | 5/1974 | Glovanniello | 70/202 |
| 4,036,077 | 7/1977 | Akiyama | 74/256 |
| 4,208,060 | 6/1980 | St. Laurent | 74/18.2 |
| 4,269,081 | 5/1981 | Peterson et al. | 74/473 |
| 4,282,769 | 8/1981 | Sandrock | 74/475 |
| 4,326,432 | 4/1982 | Miller | 74/475 |
| 4,421,287 | 12/1983 | Durno | 244/223 |
| 4,522,081 | 6/1985 | Mackin et al. | 74/471 R |
| 4,548,094 | 10/1985 | Huitema et al. | 74/526 |
| 4,704,915 | 11/1987 | Friesen et al. | 74/471 |
| 4,708,005 | 11/1987 | Bernacchi | 70/238 |
| 4,747,279 | 5/1988 | Solow | 70/238 |
| 4,887,483 | 12/1989 | Vollath | 74/526 |
| 4,991,457 | 2/1991 | Chen | 74/473 R |
| 5,038,667 | 8/1991 | Slater | 70/199 |
| 5,325,733 | 7/1994 | Papasideris | 74/483 |
| 5,372,051 | 12/1994 | Kanematsu et al. | 74/473 R |
| 5,413,008 | 5/1995 | Brock | 74/18 |
| 5,435,199 | 7/1995 | Heron et al. | 74/18.1 |

FOREIGN PATENT DOCUMENTS

| | | | |
|---|---|---|---|
| 339296 | 4/1936 | Italy | 74/18.1 |

*Primary Examiner*—Vinh T. Luong
*Attorney, Agent, or Firm*—William C. Perry

[57] ABSTRACT

A restraint mechanism for a control lever 10 of a construction machine maintains a control lever's position in a neutral condition with respect to a control valve. A first plate 34 is pivotally mounted to a base plate 20 on the console of the machine and is movable to a first position to engage the control lever 10 and establish a neutral position. A second plate 48 is utilized to selectively secure the position of the first plate with respect to the control lever while the proper connections and adjustments are made to the linkage arrangements connecting the control lever 10 and the control valve to synchronize their respective neutral positions.

8 Claims, 4 Drawing Sheets

RESTRAINT MECHANISM FOR A CONTROL LEVER

TECHNICAL FIELD

This relates generally to control levers and more particularly to a mechanism used to restrain the control lever from movement.

BACKGROUND ART

In construction machines it is very common to have multiple levers at an operators disposal to control the movement of the machine as well as the implements that are attached to the machine. These levers are commonly positioned within an operator station mounted on the machine and are connected by various linkage arrangements to control valves that in turn control the various implements and machine functions. It is very important that these levers are adjusted properly with respect to the connecting linkage to insure efficient operation of the machine. In many instances, the adjustment of these linkages occurs at a location that is remote from that of the control levers. It is important therefore to have a positive mechanism to hold the control lever in a preselected position, usually the neutral position, so that proper adjustment may be made to the connecting linkage. In many instances more than one individual is required to maintain the position of the control lever in the neutral position while a second adjusts the connecting linkage. Aside from being inefficient in the use of personnel, it also lends itself to an inaccurate adjustment in the event two people are not available when it is necessary to make the proper adjustments.

The present invention is directed to overcoming one or more of the problems as set forth above.

DISCLOSURE OF THE INVENTION

In one aspect of the present invention, a restraint mechanism for a control lever is provided. The control lever defines a protrusion which has a notch formed therein. The protrusion is such that it extends outwardly from the control lever. A first plate has a first aperture defined therein and is pivotally mounted to a base plate that is located adjacent the control lever. The first plate is moveable between a first and second position. In the first position, the first plate is engaged with the control lever in a manner wherein the protrusion is received within the first aperture and relative movement of the control lever restrained. In its second position, the first plate is pivoted away from engagement with the control lever allowing the control lever to move freely. A second plate has an engagement portion defined thereon and is rotatably mounted to the first plate in a manner to be moveable between first and second positions. In the first position, the engagement portion is positioned for contact with the notch defined in the protrusion to maintain the first plate in its first position. In its second position, the engagement portion is moved away from engagement with the protrusion to allow the first plate to be moved to its second position.

With a restraint mechanism as set forth above, it can be seen that the position of the control lever may be selectively restrained from movement by moving the first and second plates to their first positions. By maintaining the control lever in that position, the proper connections and adjustments may be made to the linkage arrangement connecting the control lever to the various other components required to operate an implement. In doing so, the full range of motion of the implement can be accurately coordinated with the corresponding range of motion of the control lever. Further, the operation may be accomplished by a single individual both during the initial build up of the machine or at any time thereafter when service of the machine requires the dismantling of the linkage.

BEST MODE FOR CARRYING OUT THE INVENTION

Figure 1:
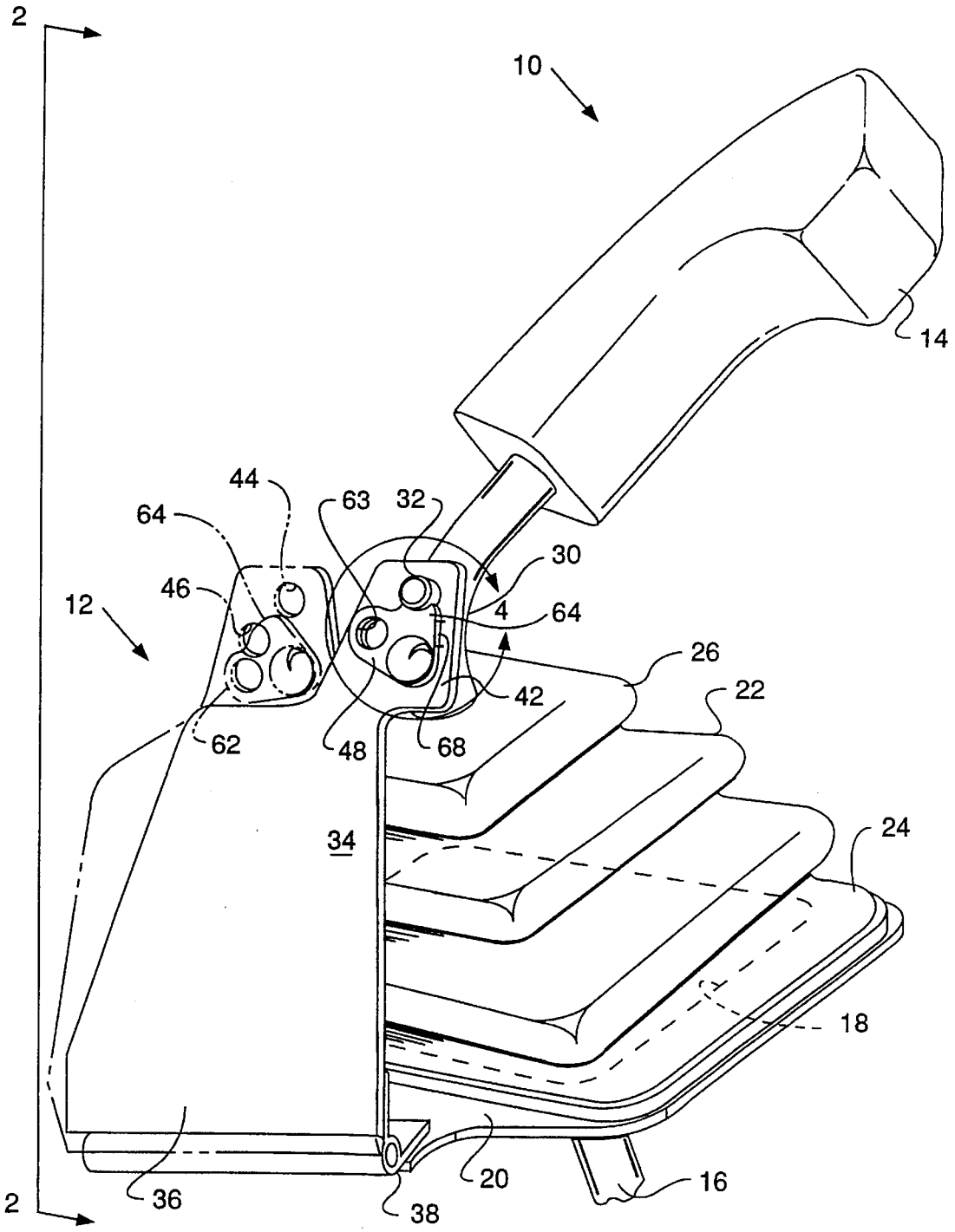
FIG. 1 is a diagrammatical perspective view of a control lever that embodies the principles of the present invention.

Referring to the drawings, a restraint mechanism for a control lever 10 is shown generally at 12. The control lever includes a handle or grasping portion 14 that is mounted on a distal end of a rod portion 16. The rod portion 16 extends through an opening 18 in a base plate 20 and is connected to a control valve (not shown) or a linkage arrangement (not shown) that is in turn connected to the control valve, for the operation of an implement. A boot 22, made of rubber or other flexible material, is mounted at its base 24 to the base plate 20 and extends upward therefrom to surround the rod portion 16 of the control lever and the opening 18. An upper portion 26 of the boot defines an aperture 28 that receives the rod portion and, since the boot material is flexible, moves with the rod portion.

The rod portion 16 defines a curved portion 30 that positions the grasping portion at a location that is comfortable for an operator to engage. A cylindrical protrusion 32 is defined along the curved portion 30 and extends outwardly from the rod portion 16. A notch 33 (FIG. 3) opens onto the cylindrical sidewall of the protrusion and is positioned in radial orientation with respect to the cylinder. The protrusion may be permanently attached to the rod portion as by welding or the like.

A first plate 34 is positioned adjacent the control lever 10 and defines a first end portion 36 that is attached to the base plate 20 by a hinge member 38. The hinge member 38 includes a torsion spring 40 that biases the plate outwardly, or to the right as viewed in FIG. 2. The first plate extends upward from its first end portion 36 and is inwardly tapered to define a narrowed second end portion 42. The second end portion 42 defines a first and second aperture 44 and 46 respectively, that are positioned in relatively close proximity to one another.

Figure 3:
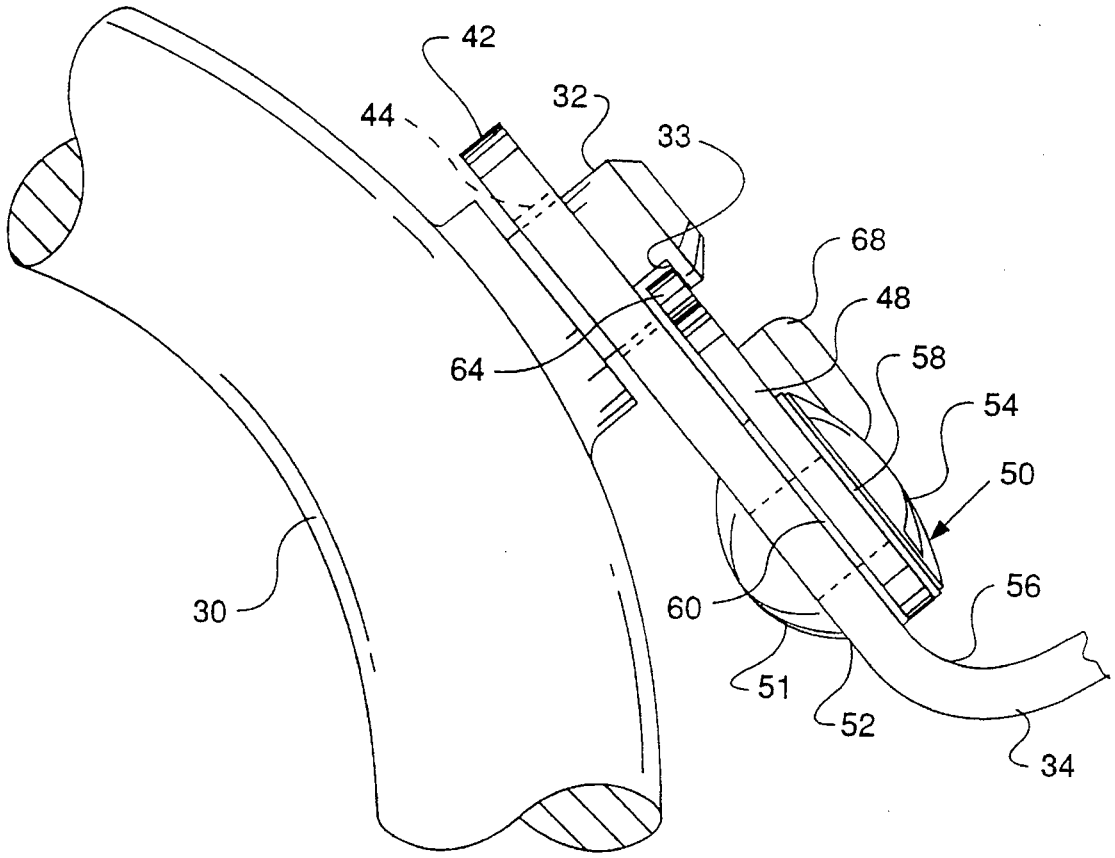
FIG. 3 is an enlargement of the area indicated by the numeral 3 shown in FIG. 2.

A second plate 48 is pivotally mounted to the second end portion 42 of the first plate 34 by a rivet assembly 50 (FIG. 3). The rivet assembly 50 has a first head portion 51 that bears against a first side 52 of the first plate member and a second head portion 54 that is positioned on a second side 56. A pair of spring washers 58 and 60 are positioned on opposing sides of the second plate 48. As is best shown in FIG. 3, spring washer 58 is sandwiched between the second head portion 54 and the second plate on one side of the second plate while spring washer 60 is sandwiched between the first and second plates on the opposite side. The second plate 48 defines a first ear portion 62 that has an aperture 63 formed therethrough. A curvilinear engagement portion 64 is defined by the second plate and intersects the first ear portion 62 at juncture indicated at 66. The intersection point 66 defines a position limiting portion of the second plate since it will engage the protrusion and prevent further rotation of the second plate with respect to the first plate when the second plate is rotated towards an engaged position. An upstruck flange 68 extends from the second plate 48 and forms a grasping portion so that the second plate may be moved relative to the first plate between an engaged and disengaged position.

Industrial Applicability

Figure 2:
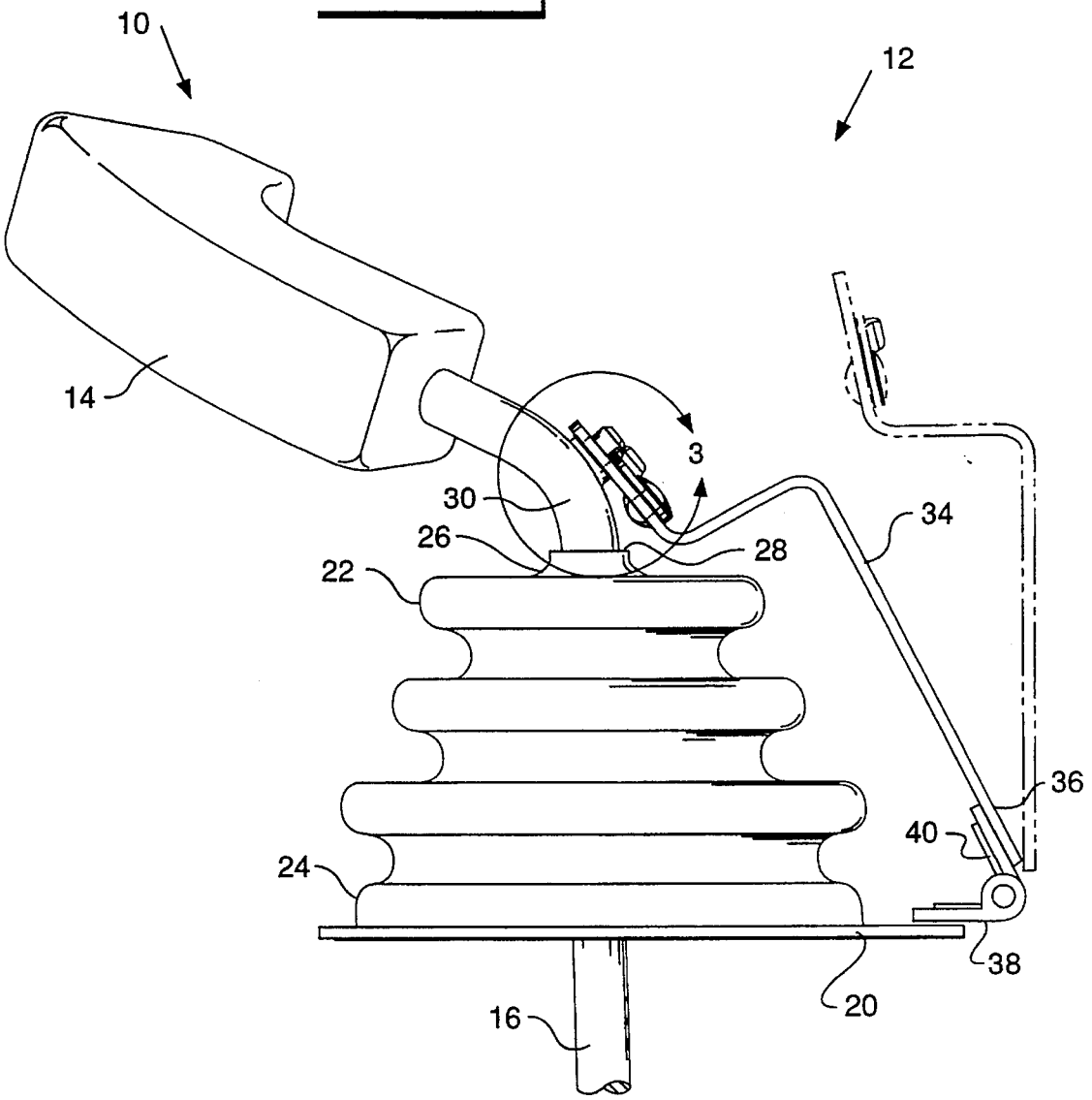
FIG. 2 is a diagrammatical end view taken along lines 2—2 as shown in FIG. 1.
Figure 4:
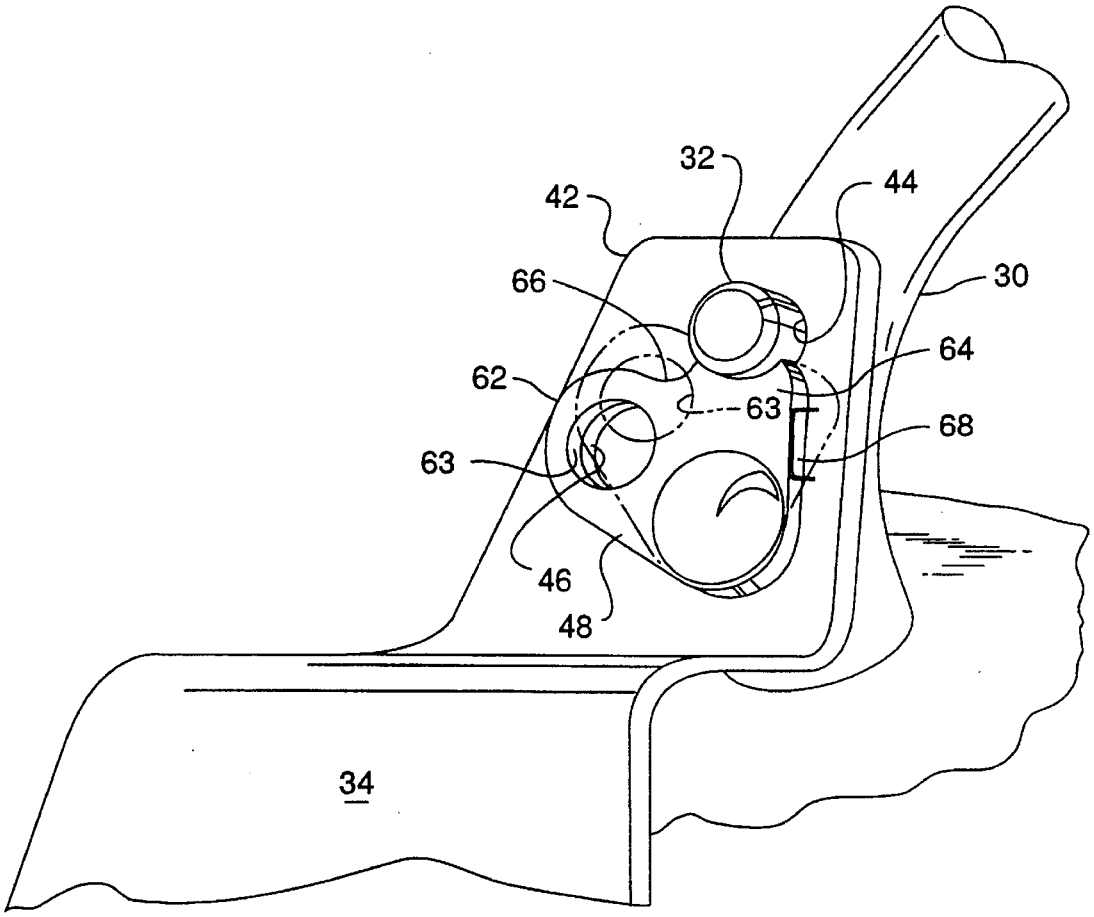
FIG. 4 is an enlargement of the area indicate by the numeral 4 shown in FIG. 1.

When in use, the first plate 34 is rotated inwardly, or to the left as viewed in FIG. 2, and the control lever is moved to a position to place the protrusion 32 in registry with the first aperture 44 defined in the first plate. This first position will establish a neutral position for the control lever. In this position, the notch 33 is positioned on the second side 56 of the first plate 34. At this point, the flange 68 of the second plate 48 may be engaged to rotate the second plate in a clockwise direction as viewed in FIGS. 1 and 4, to a first position wherein the engagement portion 64 is brought into registry with the notch 33. As the engagement portion becomes fully positioned within the notch, the aperture 63 will be moved into alignment with the second aperture 46 in the first plate 34. Being so aligned, the apertures are sufficient for receiving the shackle of a padlock or a similar device that will prevent the unwarranted movement of the engagement portion 64 of the second plate out of registry with the notch 33. In the event that no padlock is desired to be used, the second plate can only be rotated in a clockwise direction until the junction 66 between the ear 62 and the engagement portion 64 comes into contact with the protrusion 32. This prevents the engagement portion from being "rotated through" the notch, beyond its first position. Otherwise, the spring washers 58 and 60 provide enough friction against the second plate 48 to maintain its position with respect to the first plate 34.

With the control lever maintained in this position, a "neutral" position for the control linkage is established. Once the neutral position has been established, the remainder of the linkage connecting the control lever to a control valve, may be properly adjusted to insure that movement of the control lever will provide the desired operation of the implement. Once the final adjustments have been made to the connecting linkage, the flange 68 of the second plate 48 may be engaged to rotate the second plate in a counterclockwise direction to a second or disengaged position (shown in phantom lines in FIG. 1). With the engagement portion 64 rotated out of registry with the notch 33, the first plate 34, under the bias of the spring 40 in the hinge member 38, will be allowed to be moved to a second position, away from contact with the control lever 10. In this position, the control lever is allowed to be moved in a full range of motion.

With a restraint mechanism as set forth above, the linkage arrangement connecting a control lever to a control valve may be accurately adjusted in an efficient, cost effective manner with a minimum number of service personnel.

Other aspects, objects and advantages of this invention can be obtained from a study of the drawings, the disclosure and the appended claims.

We claim:

1. A control lever restraint mechanism, comprising:

a control lever;

a protrusion having a notch defined therein and being mounted on the control lever to extend outwardly therefrom;

a first plate having a first aperture defined therein, said first plate being pivotally mounted adjacent the control lever for movement between a first position in which the protrusion is received within the first aperture and relative movement of the control lever is restrained and a second position in which the protrusion is disengaged from the first aperture and relative movement of the control lever is unrestrained; and a second plate having an engagement portion defined thereon and being rotatably mounted to the first plate for movement between a third position in which the engagement portion is engaged with the notch to maintain the first plate in its first position and a fourth position in which the engagement portion is disengaged from the notch to allow the first plate to be moved to its second position.

2. The restraint mechanism as set forth in claim 1 wherein the protrusion is a cylindrical pin member and the notch is positioned in a radial direction with respect to the cylindrical pin member.

3. The restraint mechanism as set forth in claim 1 wherein the first plate has a first end portion connected to a hinge member, said hinge member being spring loaded to bias the first plate toward its second position.

4. The restraint mechanism as set forth in claim 1 wherein the first aperture is defined in a second end portion of the first plate and a second aperture is defined in the second end portion adjacent the first aperture.

5. The restraint mechanism as set forth in claim 4 wherein the second plate further defines a third aperture, said second plate being pivotally mounted to the second portion of the first plate for movement between the third position in which the engagement portion is positioned within the notch of the protrusion and the third aperture is aligned with the second aperture of the first plate and the fourth position in which the engagement portion is disengaged from the notch.

6. The restraint mechanism as set forth in claim 5 wherein a position limiting portion is defined on the second plate, said position limiting porting being adapted to engage the protrusion to limit the movement of the second plate toward its third position.

7. The restraint mechanism as set forth in claim 6 wherein an upstruck flange is defined on the second plate member and is engageable to move the second plate between its first and second positions.

8. The restraint mechanism as set forth in claim 5 wherein the pivot mounting between the first and second plates includes a pair of spring washers positioned on opposing sides of the second plate and a rivet member having a first head portion engaging one of the spring washers and a second head portion positioned to engage the first plate on a side opposite that of the section plate, said rivet being adapted to secure the second plate to the first plate in a manner to compress the spring washers an amount sufficient to provide a preselected amount of resistance to the rotation of the second plate with respect to the first plate.

* * * * *